US011098871B2

(12) United States Patent
Bursy et al.

(10) Patent No.: US 11,098,871 B2
(45) Date of Patent: Aug. 24, 2021

(54) HEADLAMP FOR VEHICLES

(71) Applicant: Hella GmbH & Co. KGaA, Lippstadt (DE)

(72) Inventors: Marcel Bursy, Berlin (DE); Markus Giehl, Lippstadt (DE); Julien Hansen, Delmenhorst (DE); Marc Kaup, Paderborn (DE); Thomas Rettweiler, Lippstadt (DE); Christian Schmidt, Paderborn (DE); Christian Smarslik, Lippstadt (DE); Philip Stroop, Schloß Holte-Stukenbrock (DE); Carsten Wilks, Lippstadt (DE); Benjamin Willeke, Paderborn (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/954,898

(22) PCT Filed: Dec. 22, 2017

(86) PCT No.: PCT/EP2017/084380
§ 371 (c)(1),
(2) Date: Jun. 17, 2020

(87) PCT Pub. No.: WO2019/120565
PCT Pub. Date: Jun. 27, 2019

(65) Prior Publication Data

US 2020/0393106 A1 Dec. 17, 2020

(51) Int. Cl.
*F21S 41/675* (2018.01)
*F21S 41/16* (2018.01)
(Continued)

(52) U.S. Cl.
CPC ..... *F21S 41/675* (2018.01); *F21S 41/125* (2018.01); *F21S 41/16* (2018.01); *F21S 41/285* (2018.01);
(Continued)

(58) Field of Classification Search
CPC ..... F21S 41/16; F21S 41/675
See application file for complete search history.

(56) References Cited

U.S. PATENT DOCUMENTS

2011/0249460 A1 10/2011 Kushimoto
2015/0375672 A1 12/2015 Takahashi
(Continued)

FOREIGN PATENT DOCUMENTS

DE 102014223933 A1 5/2016
EP 3096074 A1 11/2016
(Continued)

*Primary Examiner* — Sean P Gramling
(74) *Attorney, Agent, or Firm* — Husch Blackwell LLP

(57) ABSTRACT

A headlamp for vehicles comprising at least one light source for generating at least one light beam, a scanning device for one-dimensionally scanning the at least one light beam bidirectionally in a scanning direction, and an array of optical elements arranged side by side in a direction that corresponds to the scanning direction so that the at least one light beam impinges on the optical elements successively. At least some of the optical elements are designed to expand the at least one light beam in a direction perpendicular to the direction, in which the optical elements are arranged side by side.

11 Claims, 1 Drawing Sheet

(51) Int. Cl.

| | |
|---|---|
| ***F21S 41/125*** | (2018.01) |
| ***F21S 41/20*** | (2018.01) |
| *F21Y 115/30* | (2016.01) |
| *F21Y 113/10* | (2016.01) |

(52) U.S. Cl.
CPC ..... *F21Y 2113/10* (2016.08); *F21Y 2115/30* (2016.08)

(56) References Cited

U.S. PATENT DOCUMENTS

| | | | | |
|---|---|---|---|---|
| 2016/0018066 | A1 | 1/2016 | Abelé et al. | |
| 2017/0175968 | A1 * | 6/2017 | Shimizu | G03H 1/0248 |

FOREIGN PATENT DOCUMENTS

| | | | | |
|---|---|---|---|---|
| WO | 2013099144 | A1 | 7/2013 | |
| WO | WO-2013099144 | A1 * | 7/2013 | F21S 41/60 |
| WO | 2014121314 | A1 | 8/2014 | |

* cited by examiner

HEADLAMP FOR VEHICLES

CROSS REFERENCE

This application claims priority to PCT Application No. PCT/EP2017/084380, filed Dec. 22, 2017, the entirety of which is hereby incorporated by reference.

FIELD OF THE INVENTION

The present invention relates to a headlamp for vehicles.

BACKGROUND

A headlamp of the aforementioned type is known from WO 2014/121314 A1. This headlamp comprises four laser light sources for generating laser beams and a micro-mirror device for one-dimensionally scanning the laser beams bidirectionally in a scanning direction. The scanned laser beams impinge on conversion means for converting the laser light into white light. The headlamp further comprises a projection system for projecting the converted light onto the road in front of the vehicle. The conversion means cause considerable losses. Furthermore the color of the converted light cannot be changed. Additionally a relatively big projection system is needed for projecting the converted light onto the road.

Another headlamp is known from US 2007/0177250 A1. This headlamp comprises a light source for generating a light beam and micro-mirrors for two-dimensionally scanning the light beam in two directions, which are perpendicular to each other, in especially in a horizontal and a vertical direction. Thus the headlamp can achieve a two-dimensional light distribution pattern in front of the vehicle. For providing a high resolution light distribution pattern the micro-mirror has to move very fast and the light source must be a high-power light source.

SUMMARY OF THE INVENTION

The problem to be solved by the present invention is thus to provide a headlamp of the aforementioned kind, which can achieve a two-dimensional light distribution pattern in front of the vehicle, in particular a high resolution light distribution pattern, more effectively.

The headlamp comprises an array of optical elements, which are arranged side by side in a direction that corresponds to the scanning direction, so that the at least one light beam impinges on the optical elements successively, wherein at least some of the optical elements are designed to expand the at least one light beam in a direction perpendicular to the direction, in which the optical elements are arranged side by side. Thus despite of the only one-dimensional scanning of the at least one light beam the optical elements can contribute to a two-dimensional light distribution pattern in front of the vehicle.

Within the vehicle the optical elements may be arranged side by side in a horizontal direction, whereas the optical elements can expand the at least one light beam in the vertical direction. Due to this orientation of the optical elements the light-emitting surface of the headlamp is elongated in an horizontal direction and quite narrow in the vertical direction. This can result in an attractive design of the headlamp.

In particular, at least one or some of the optical elements may be lenses and/or prisms and/or plates. For instance an optical element designed as a lens may be a spherical lens or a cylindrical lens or an anamorphic lens. Such elements are able to expand the at least one light beam effectively.

The potential exists that the scanning frequency of the scanning device is greater than the flicker fusion frequency, so that the emitted light distribution appears steady to an observer, wherein in particular the scanning frequency of the scanning device is greater than 200 Hz. Due to a scanning frequency of more than 200 Hz the scanned light beam results in a light distribution pattern, which an observer perceives as a static light distribution pattern.

It may be provided that the at least one light source is a laser light source, especially an RGB laser light source, wherein in particular the RGB laser light source comprises three single lasers, which emit a red, a green and a blue laser beam, respectively, wherein the laser beams of the three lasers are being overlapped so that a single white laser beam is emitted by the RGB laser light source. The RGB laser light source might be able to generate an output beam with a predetermined color temperature or a temporally altering color temperature. Therefore, a light distribution pattern with different colors may be provided.

In an alternative embodiment the at least one light source could be a laser light source with conversion means for producing white light. In a further alternative embodiment the at least one light source could be a LED.

The potential exists that the headlamp comprises optical means for overlapping and for guiding the laser beams, wherein in particular the headlamp could comprise an optical fiber coupler for overlapping the laser beams of the three lasers and three optical fibers arranged between the three lasers and the fiber coupler for directing the laser light to the fiber coupler. The optical fiber coupler reliably ensures the overlapping of the laser beams.

It is furthermore possible that the headlamp comprises a plurality of optical fibers arranged between the scanning device and the array of optical elements for directing the scanned light beam to the optical elements, wherein in particular one of the optical fibers is assigned to one of the optical elements. This configuration may facilitate the arrangement of the components in the headlamp. Additionally, more degrees of freedom are achieved for designing the headlamp.

It may be provided that the headlamp comprises more than one array of optical elements, wherein the arrays are arranged above each other in a direction perpendicular to the direction, in which the optical elements are arranged side by side. Especially in this case the headlamp could comprise more than one light source, wherein in particular one of the light sources is assigned to one of the arrays of optical elements.

The potential exists that the headlamp comprises control means for controlling the at least one light source according to the scanning of the at least one light beam, wherein in particular the intensity or the color of the at least one light beam can be changed to achieve a favored light distribution pattern. Thus the light distribution pattern can be designed very flexibly.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
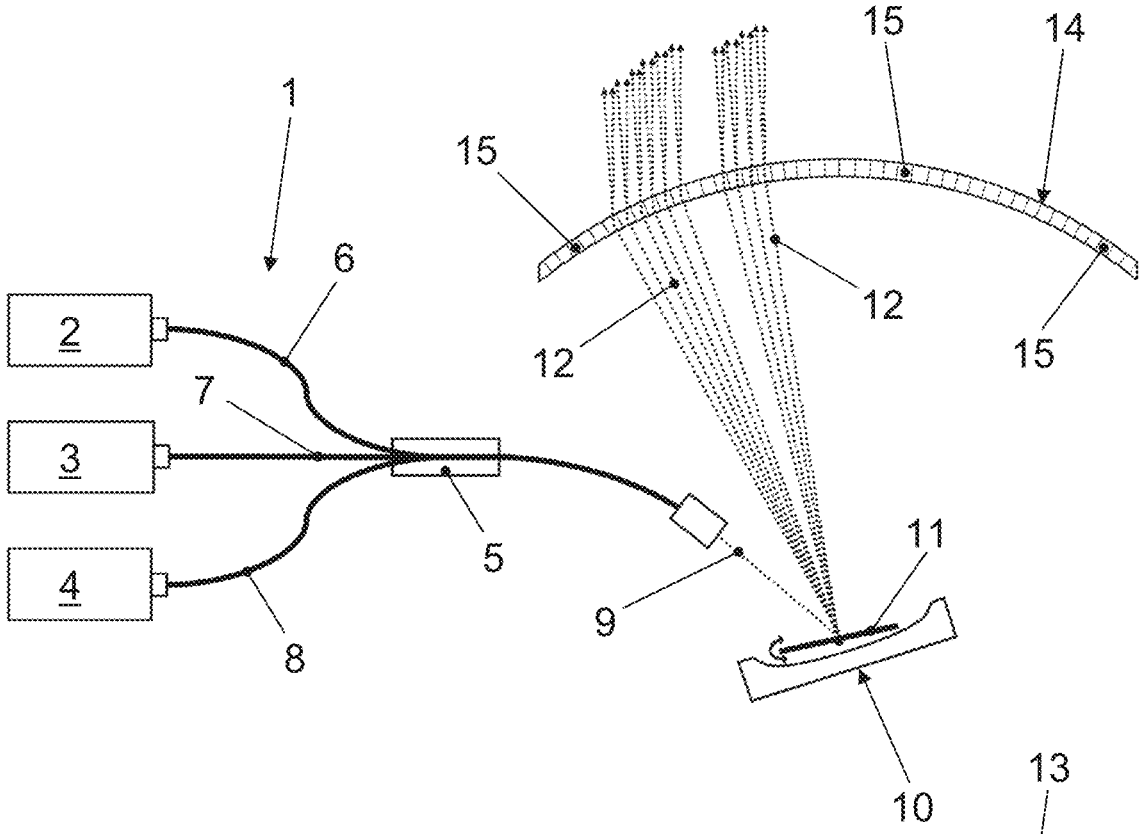
FIG. 1 is a schematic diagram of a headlamp according to the invention.

In the figures, identical or functionally identical parts or light beams are designated with identical reference numerals.

The headlamp illustrated in FIG. 1 comprises a light source 1 being an RGB laser light source having three single lasers 2, 3, 4, which emit a red, a green and a blue laser beam, respectively. The RGB laser light source is provided with an optical fiber coupler 5 for overlapping the laser beams of the three lasers 2, 3, 4. The light source 1 further comprises three optical fibers 6, 7, 8 arranged between the three lasers 2, 3, 4 and the fiber coupler 5 for directing the laser light to the fiber coupler 5.

Due to the color of the three lasers 2, 3, 4 the RGB laser light source emits an output light beam 9 having a color temperature which corresponds to white light. The light beam 9 has a comparatively small diameter and possesses only a small divergence. The headlamp comprises control means which are not shown in the figures. The control means can drive the three individual lasers 2, 3, 4 accordingly to generate a light beam 9 with a predetermined color temperature.

Furthermore, the headlamp illustrated in FIG. 1 comprises scanning device 10 for one dimensionally scanning the light beam 9 bidirectionally in a scanning direction, which is located in the plane of projection of FIG. 1. Within the vehicle the scanning direction is located in a horizontal plane. The scanning device 10 could be a galvanometer scanner or a MEMS mirror. FIG. 1 schematically shows a mirror 11, which can be tilted around an axis perpendicular to the plane of projection of FIG. 1. In FIG. 1 several different positions of the scanned beam 12 are illustrated.

The scanning frequency of the scanning device 10 should be greater than 200 Hz. Due to a scanning frequency of more than 200 Hz the scanned light beam 12 results in a light distribution pattern 13 (see FIG. 2), which an observer perceives as a static light distribution pattern.

Furthermore, the headlamp illustrated in FIG. 1 comprises an array 14 of at least partially transparent optical elements 15, which are arranged side by side in a direction that corresponds to the scanning direction. Therefore, the scanned light beam 12 impinges on the optical elements 15 successively (see FIG. 1 and FIG. 2).

At least one or some of the optical elements 15 may be lenses and/or prisms and/or plates. For instance an optical element 15 designed as a lens may be a spherical lens or a cylindrical lens or an anamorphic lens. Such elements 15 are able to expand the light beam 12 in a direction perpendicular to the direction, in which the optical elements 15 are arranged side by side. Within the vehicle the optical elements 15 are arranged side by side in a horizontal direction, whereas at least some of the optical elements 15 expand the light beam 12 in the vertical direction.

The optical elements 15 can differ from each other. Especially at least some of the optical elements 15 can differ from each other with regard to their ability to deflect the light beam 9 in the horizontal and/or the vertical direction.

Figure 2:
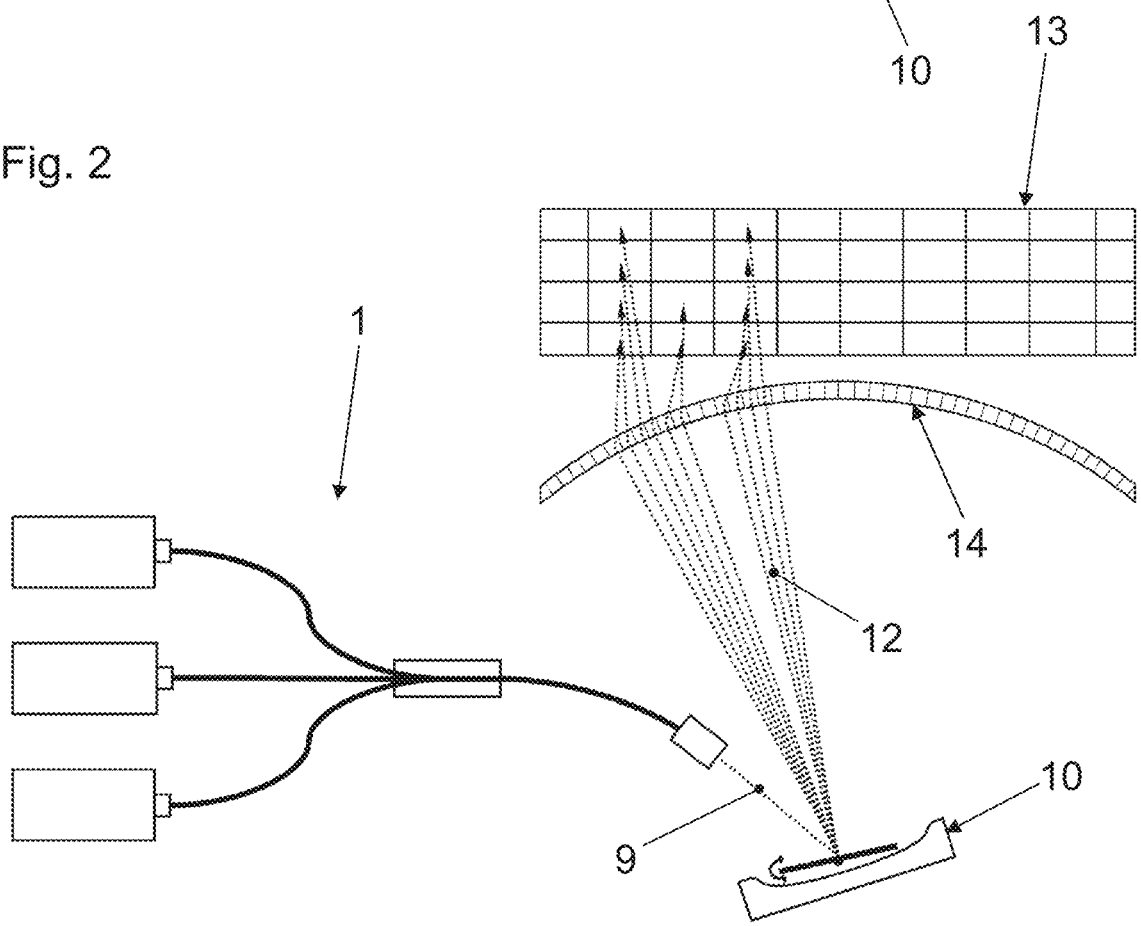
FIG. 2 is a schematic diagram similar to FIG. 1 with a schematically indicated light distribution pattern.

FIG. 2 shows schematically a light distribution pattern 13 in front of the vehicle. The control means for controlling the RGB laser light source can change the color or the intensity of the beam 9 during the scanning of the beam 9. For instance the scanned beam 12 can be less intensive in a first angle range than in a second angle range.

Thus the control means as well as the optical elements 15 can contribute to a flexible design of the light distribution pattern 13.

In an alternative embodiment the headlamp comprises a plurality of optical fibers (not shown) arranged between the scanning device 10 and the array 14 of optical elements 15 for directing the scanned light beam 12 to the optical elements 15. In this case one of the optical fibers could be assigned to one of the optical elements 15.

In a further alternative embodiment the headlamp comprises more than one array 14 of optical elements 15 (not shown), wherein the arrays 15 are arranged above each other in the vertical direction. In this case the headlamp could comprise more than one RGB laser light sources, wherein in particular one of the RGB laser light sources is assigned to one of the arrays 14 of optical elements 15.

LIST OF REFERENCE SYMBOLS

1 light source
2 laser for emitting a red laser beam
3 laser for emitting a green laser beam
4 laser for emitting a blue laser beam
5 optical fiber coupler
6 optical fiber
7 optical fiber
8 optical fiber
9 light beam
10 scanning device
11 mirror
12 scanned beam
13 light distribution pattern
14 array
15 optical element

The invention claimed is:

1. A headlamp for vehicles, the headlamp comprising:

at least one light source for generating at least one light beam;

a scanning device for one-dimensionally scanning the at least one light beam bidirectionally in a scanning direction to generate a scanned beam, an array of optical elements arranged side by side in a direction that corresponds to the scanning direction, so that the scanned beam impinges on the optical elements successively, wherein the optical elements physically abut one another to form the array of optical elements, wherein at least some of the optical elements expand the at least one light beam in a direction perpendicular to the direction in which the optical elements are arranged side by side, wherein the scanned beam is directly transmitted from the scanning device to the array of optical elements.

2. The headlamp according to claim 1, wherein at least one or some of the optical elements are at least one of lenses, prisms, and plates.

3. The headlamp according to claim 2, wherein an optical element designed as a lens is a spherical lens or a cylindrical lens or an anamorphic lens.

4. The headlamp according to claim 1, wherein the scanning frequency of the scanning device is greater than the flicker fusion frequency, so that the emitted light distribution appears steady to an observer, wherein in particular the scanning frequency of the scanning device is greater than 200 Hz.

5. The headlamp according to claim 1, wherein the at least one light source is an RGB laser light source that comprises three single lasers, which emit a red, a green and a blue laser beam, respectively, wherein the laser beams of the three lasers are being overlapped so that a single white laser beam is emitted by the RGB laser light source.

6. The headlamp according to claim 5, wherein the headlamp comprises optical means for overlapping and for guiding the laser beams, wherein the headlamp comprises an optical fiber coupler for overlapping the laser beams of the three lasers and three optical fibers arranged between the three lasers and the fiber coupler for directing the laser light to the fiber coupler.

7. The headlamp according to claim 1, wherein the headlamp comprises a plurality of optical fibers arranged between the scanning device and the array of optical elements for directing the scanned light beam to the optical elements, wherein one of the optical fibers is assigned to one of the optical elements.

8. The headlamp according to claim 1, wherein the headlamp comprises more than one array of optical elements, wherein the arrays are arranged above each other in a direction perpendicular to the direction, in which the optical elements are arranged side by side.

9. The headlamp according to claim 1, wherein the headlamp comprises more than one light source, wherein in particular one of the light sources is assigned to one of the arrays of optical elements.

10. The headlamp according to claim 1, wherein the headlamp comprises control means for controlling the at least one light source according to the scanning of the at least one light beam, wherein the intensity or the color of the at least one light beam can be changed to achieve a favored light distribution pattern.

11. A headlamp for vehicles, the headlamp comprising:

at least one light source for generating at least one light beam;

a scanning device for one-dimensionally scanning the at least one light beam bidirectionally in a scanning direction to generate a scanned beam, an array of optical elements arranged side by side in a direction that corresponds to the scanning direction, so that the scanned beam impinges on the optical elements successively, wherein the optical elements physically abut one another to form the array of optical elements, wherein at least some of the optical elements expand the at least one light beam in a direction perpendicular to the direction in which the optical elements are arranged side by side, wherein the scanned beam is transmitted from the scanning device to the array of optical elements through a plurality of optical fibers wherein each of the optical fibers corresponds to one of the optical elements respectively.

* * * * *